US007510180B2

(12) United States Patent
Jang et al.

(10) Patent No.: US 7,510,180 B2
(45) Date of Patent: Mar. 31, 2009

(54) BYPASS TRAY AND IMAGE FORMING APPARATUS WITH THE SAME

(75) Inventors: Kyung-hwan Jang, Suwon-si (KR); Yong-whan Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 441 days.

(21) Appl. No.: 11/246,222

(22) Filed: Oct. 11, 2005

(65) Prior Publication Data

US 2006/0180994 A1 Aug. 17, 2006

(30) Foreign Application Priority Data

Oct. 12, 2004 (KR) ..... 10-2004-0081355

(51) Int. Cl.
*B65H 1/08* (2006.01)

(52) U.S. Cl. ..... 271/127; 271/117; 271/157; 271/160; 271/162; 399/110; 399/125

(58) Field of Classification Search ..... 271/117, 271/157, 160, 162, 127; 399/110, 125
See application file for complete search history.

(56) References Cited

U.S. PATENT DOCUMENTS 3,827,687 A * 8/1974 Kono ..... 271/117
3,989,236 A * 11/1976 Komori et al. ..... 271/4.1
4,872,660 A * 10/1989 Kameyama et al. ..... 271/9.02
5,145,160 A * 9/1992 Nagashima et al. ..... 271/9.09
5,232,214 A * 8/1993 Matsuura et al. ..... 271/127
5,573,235 A * 11/1996 Asai ..... 271/121
5,823,525 A * 10/1998 Miki ..... 271/127
6,089,562 A * 7/2000 Jang et al. ..... 271/10.11
6,227,533 B1 * 5/2001 Jang ..... 271/109
6,337,751 B1 * 1/2002 Kimizuka ..... 358/498
6,382,617 B1 * 5/2002 Yen et al. ..... 271/3.14
6,938,893 B2 * 9/2005 Shin ..... 271/170
7,131,644 B2 * 11/2006 Williamson et al. ..... 271/121
7,267,336 B2 * 9/2007 Kojima ..... 271/145
7,270,323 B2 * 9/2007 Somemiya ..... 271/127
7,306,217 B2 * 12/2007 Bandou et al. ..... 271/145

FOREIGN PATENT DOCUMENTS

| | | |
|---|---|---|
| JP | 9-278205 | 10/1997 |
| JP | 11-199067 | 7/1999 |
| KR | 1990-0014843 | 10/1990 |
| KR | 1994-0003113 | 4/1994 |
| KR | 1994-0003542 | 4/1994 |
| KR | 2000-0004593 | 3/2000 |

* cited by examiner

*Primary Examiner*—Patrick H Mackey
*Assistant Examiner*—Prasad V Gokhale
(74) *Attorney, Agent, or Firm*—Staas & Halsey LLP

(57) ABSTRACT

A bypass tray to be used in an image forming apparatus, the bypass tray including a knock-up plate resiliently biased in an upward direction; and at least one stopper provided at least one side of the knock-up plate, rotatably provided so as to restrict a position of the knock-up plate while moving up and down.

16 Claims, 6 Drawing Sheets

BYPASS TRAY AND IMAGE FORMING APPARATUS WITH THE SAME

CROSS-REFERENCE TO RELATED APPLICATIONS

This application claims the benefit of Korean Patent Application No. 10-2004-0081355, filed on Oct. 12, 2004, in the Korean Intellectual Property Office, the disclosure of which is incorporated herein by reference.

BACKGROUND OF THE INVENTION

1. Field of the Invention

The present invention relates to an image forming apparatus, and, more particularly, to a bypass tray of an image forming apparatus capable of preventing production of impactnoise or skewing of paper when the paper is fed through the bypass tray.

2. Description of the Related Art

In general, an image forming apparatus includes a paper loading unit to load a plurality of sheets of paper on which an image may then be formed. The paper loading unit generally includes a cassette having the plurality of sheets of paper, the cassette being detachably provided to a body of the image forming apparatus, and a bypass tray forming a part of a casing of the body to feed a sheet of a print medium, special paper, or the like.

FIGS. 1 and 2 are side views illustrating a process of picking up a sheet of paper from a conventional bypass tray.

Referring to FIGS. 1 and 2, the bypass tray includes a knock-up plate 10 with a plurality of sheets of paper S stacked thereon, a support 12 provided at one side of the knock-up plate 10, an idle roller 11 rotatably provided at one end of the support 12, and a resilient part 20 to resiliently bias the knock-up plate 10 upward, the resilient part 20 having one end fixed to the knock-up plate 10 and the other end fixed to a body (not shown) of the image forming apparatus.

The knock-up plate 10 is provided at an upper portion thereof with a pickup roller 32 fixed to a rotary shaft 30, which is rotatably provided to the body (not shown). The pickup roller 32 picks up the sheets of paper stacked on the knock-up plate 10 sheet by sheet. Idle rollers 31, idling around the rotary shaft 30, are provided to both sides of the pickup roller 32, respectively. The rotary shaft 30 is provided with a cam 33 having a latch portion 34 to secure the idle roller 11 provided to the support 12.

A process of picking up the paper from the conventional bypass tray will now be described with the accompanying drawings.

Referring to FIG. 1, since the latch portion 34 of the cam 33 latches the idle roller 11, the knock-up plate 10 is resiliently biased by the resilient part 20 upwardly, but is not moved upwardly.

When the rotary shaft 30 is rotated by a solenoid (not shown) which selectively transfers a power from a driving power (not shown) to the rotary shaft 30, the pickup roller 32 is rotated in a counterclockwise direction. Also, the cam 33 fixed to the rotary shaft 30 is rotated with the rotary shaft 30 in the counterclockwise direction.

At that time, the idle roller 11 is released from the latch portion 34, and is then rotated along an outer periphery 35 of the cam 33 in a clockwise direction. As such, the knock-up plate 10 is moved upward by a resilient force of the resilient part 20, so that the stacked paper S comes into contact with the rotating pickup roller 32, and the stacked paper is picked up sheet by sheet starting with an uppermost sheet.

A clockwise rotation of the rotary shaft 30 causes the latch portion 34 of the cam 33 to again latch the idle roller 11, as shown in FIG. 1. A next sheet is picked up by repeating the above process.

As the idle roller 11 moves along the outer periphery 35 of the cam 33, the knock-up plate 10 is moved up and down to impact the uppermost sheet of paper. Therefore, there is a problem in that impact noise is significantly produced whenever the paper is fed. In addition, an alignment of the paper S stacked on the knock-up plate 10 may be disrupted, which in turn may cause poor paper feeding, and thus skew.

SUMMARY OF THE INVENTION

One aspect of the present invention provides a bypass tray capable of preventing a knock-up plate from being impacted upon feeding, by which sheets of a printing medium are not disordered, thus preventing a skew.

In addition, the present invention provides an image forming apparatus with the same.

Additional aspects and/or advantages of the invention will be set forth in part in the description which follows and, in part, will be apparent from the description, or may be learned by practice of the invention.

According to an aspect of the present invention, there is provided an image forming apparatus including a body provided with a printing portion and a bypass tray pivotally provided to the body to feed a print medium to the image forming apparatus, the bypass tray including: a cover which is a part of a casing of the body; a knock-up plate having at least one side slidably supported by the cover, and resiliently biased to an upward direction by a resilient part; and at least one stopper positioned at at least one side of the knock-up plate, and rotatably provided to the body to restrict a position of the knock-up plate moving up and down.

According to another aspect of the present invention, there is provided a bypass tray to be used in an image forming apparatus, the bypass tray including a knock-up plate resiliently biased in an upward direction; and at least one stopper provided at at least one side of the knock-up plate, rotatably provided so as to restrict a position of the knock-up plate moving up and down.

According to another aspect of the present invention, there is provided a bypass tray to be used in an image forming apparatus, the bypass tray including a knock-up plate resiliently biased in an upward direction; wherein the knock-up plate is coupled to a body of the image forming apparatus so that movement of the knock-up plate is supportably restricted while moving up to contact a pickup roller.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
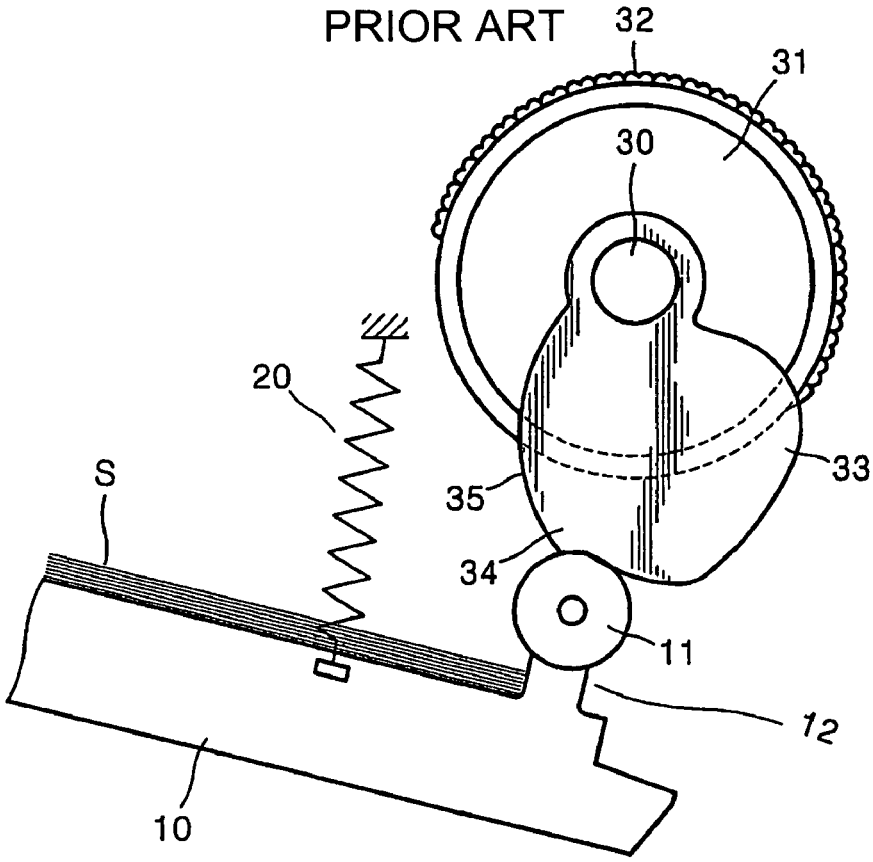
FIG. 1 PRIOR ART
FIGS. 1 and 2 are side views illustrating a process of picking up a sheet of paper from a conventional bypass tray.
Figure 2:
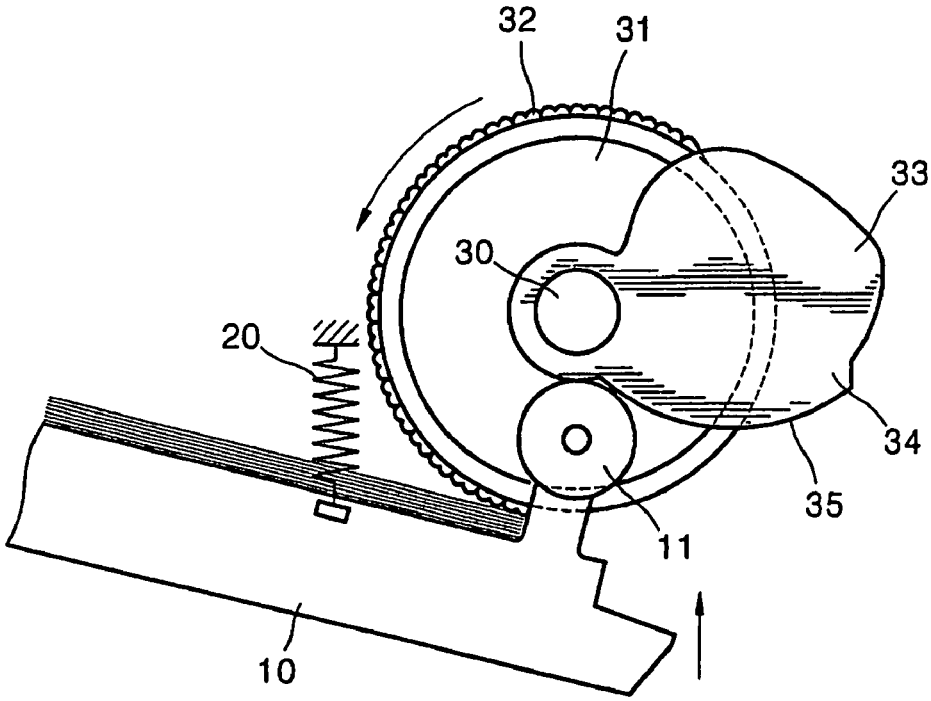
FIG. 2 PRIOR ART

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
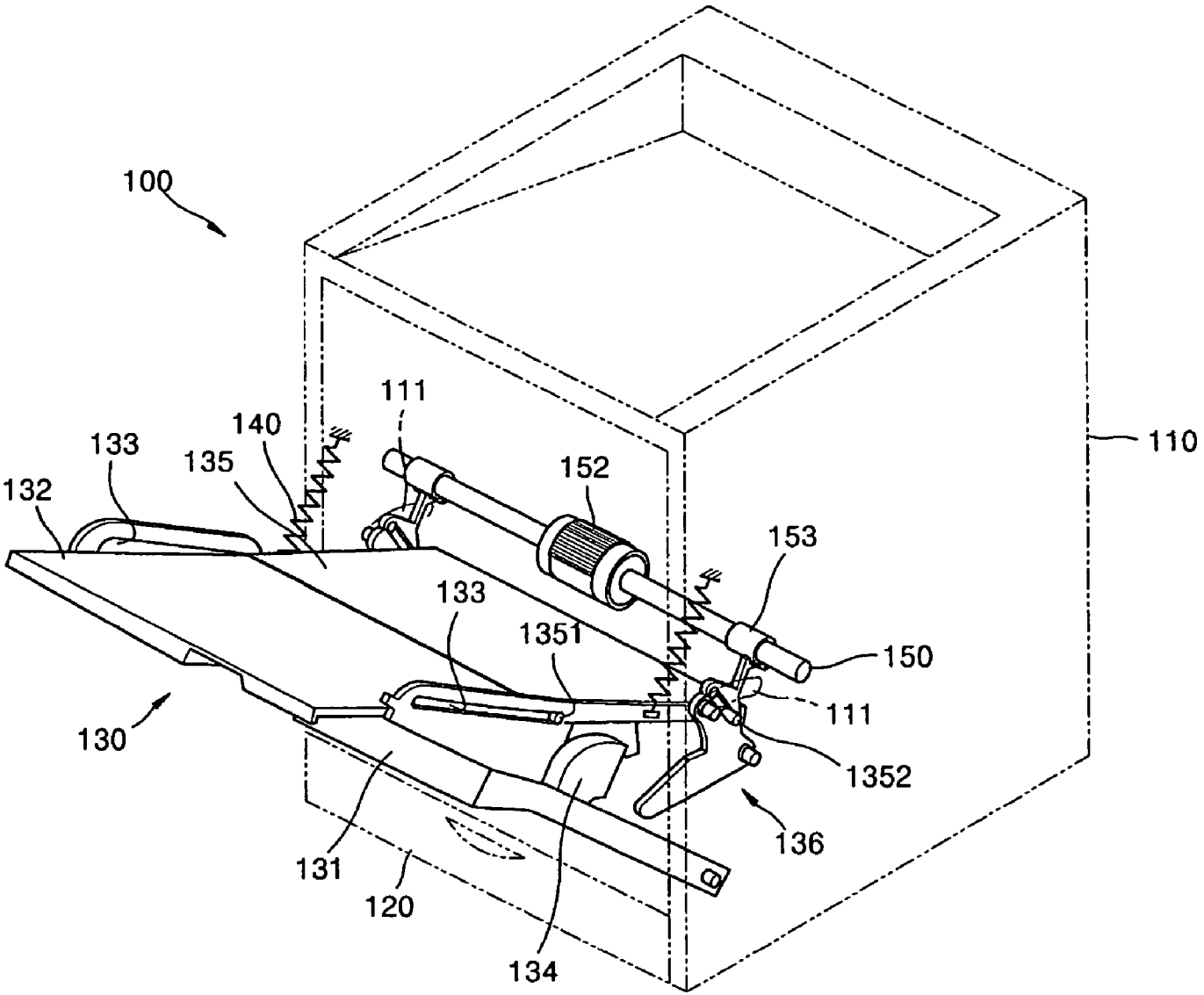
FIG. 3 is a perspective view illustrating an image forming apparatus with a bypass tray according to an embodiment of the present invention.

Referring to FIG. 3, an image forming apparatus 100 includes a body 110 provided with a printing unit (not shown), a cassette 120, having a plurality of sheets of paper, detachably provided to the body 110, and a bypass tray 130 pivotally provided to the body 110 to feed a sheet of a print medium. The print medium may be a normal sheet such as that enclosed in the cassette, a special print medium, or the like.

The bypass tray 130 includes a cover 131, a knock-up plate 135, and stoppers 136.

The cover 131 is a part of a casing of the body 110, and has a support plate 132 to support the paper on an inner side thereof. The support plate 132 is provided at both respective sides thereof with an extended guide hole 133. The cover 131 has restoring portions 134 extending inwardly from both respective sides of the cover 131 by a desired length.

The knock-up plate 135 is positioned on an inner portion of the cover 131, and has a pair of first bosses 1351 formed at both respective sides of the upper portion of the knock-up plate 135. The first boss 1351 is inserted into the guide hole 133 so that it can reciprocally slide along the guide hole 133. When the cover 131 is closed by moving it toward the body 110, the first boss 1351 slides along the guide hole 133, and the knock-up plate 135 overlays on the upper portion of the support plate 132. FIG. 3 shows an open state in which the cover 131 is opened by being moved away from the body 110.

The knock-up plate 135 is upwardly biased by a resilient part 140 coupled to the body 110. The knock-up plate 135 is provided at both respective sides of the bottom portion thereof with a pair of second bosses 1352. Each of the second bosses 1352 is cooperatively coupled to one of the respective stoppers 136.

Figure 4:
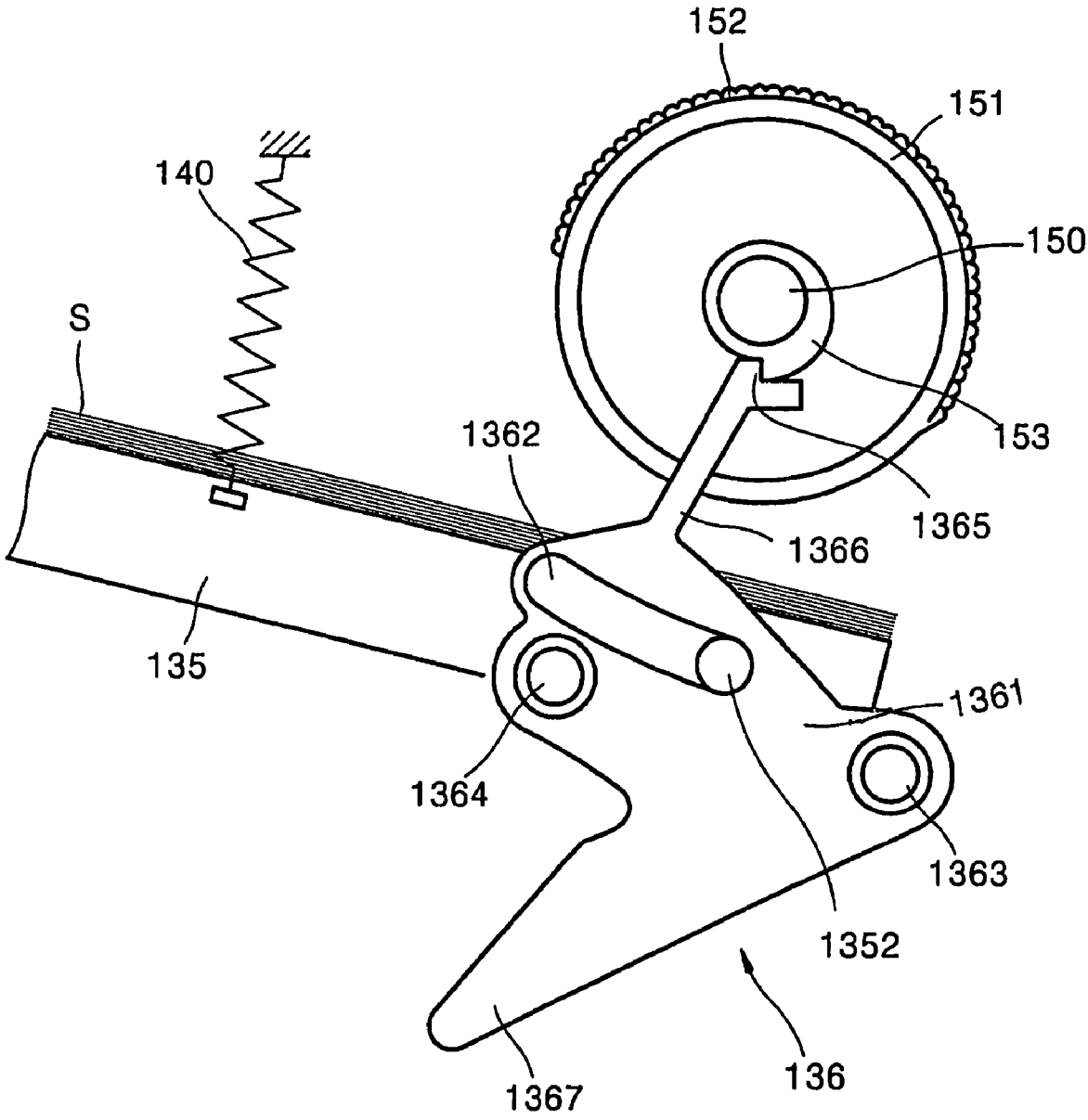
FIGS. 4 and 5 are side views illustrating an operation of the bypass tray in FIG. 3.
Figure 5:
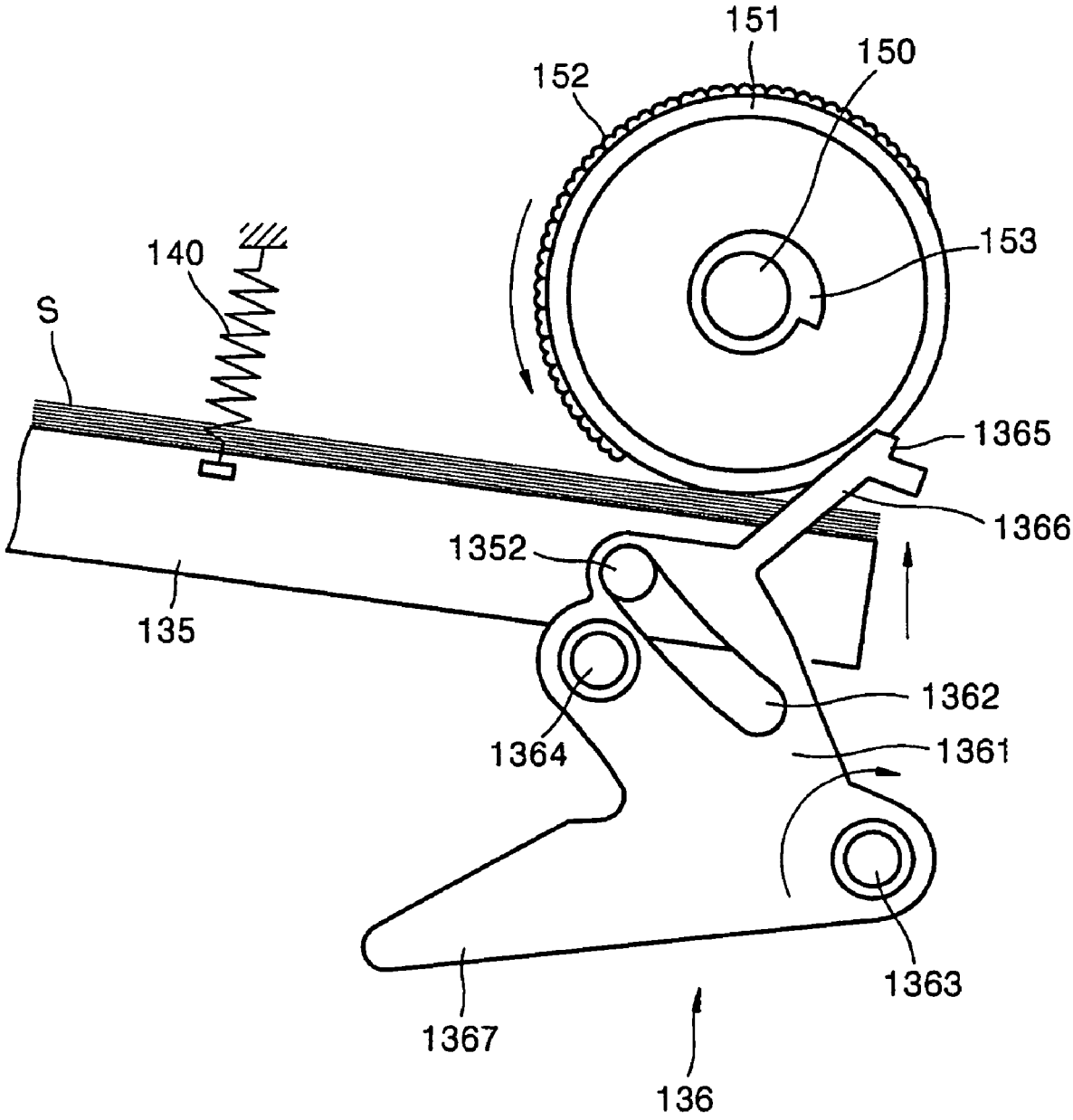

The stoppers 136 are positioned at both sides of the knock-up plate 135, respectively, as shown in FIG. 3. Further, as shown in FIGS. 4 and 5, the stoppers 136 are rotatably provided to the body 110 so as to restrict the position of the knock-up plate 135 in moving up and down. Each stopper 136 includes a base 1361, a pivot portion 1366, and a rib 1367.

The base 1361 includes a guide hole 1362 through which the second boss 1352 is slidably inserted, a pivot shaft 1363 extending from one side of the base 1361 and rotatably provided to the body 110, and a support 1364 extending from the base 1361 in the same direction as that of the pivot shaft 1363, and slidably inserted into a groove 111 provided at the body 110 to stably support the base 1361 when the base 1361 rotates around the pivot shaft 1363.

The pivot portion 1366 extends from the base 1361, and has a stop portion 1365 at one end of the pivot portion 1366. The stop portion 1365 is positioned at a lower portion of the bypass tray 130, and a position of the stop portion 1365 is restricted by a cam 153 fixed to the rotary shaft 150, which is rotatably provided to the body 110.

The rib 1367 extends from the base 1361 in a direction away from the pivot portion 1366, and causes the base 1361 to rotate around the pivot shaft 1363 when the rib 1367 comes into contact with the restoring portion 134.

A pickup roller 152 is provided to the rotary shaft 150 to pick up a sheet of paper S. An idle roller 151 is provided to both sides of the pickup roller 152 in such a way that the idle roller can idle with respect to the rotary shaft 150.

A process of picking up the paper from the bypass tray according to the present invention will now be described with reference to the accompanying drawings.

Referring to FIGS. 3 and 4, when the cover 131 is opened from the body 110, the support plate 132 and the knock-up plate 135 are exposed to the outside. The knock-up plate 135 is resiliently biased upward by the resilient part 140.

At that time, the stop portion 1365 of the pivot portion 1366 is caught by the cam 153, and the second boss 1352 is inserted into the guide hole 1362. The knock-up plate 135 is spaced apart from the pickup roller 152 at a desired interval against the resilient force of the resilient part 140. A plurality of sheets of paper S, on which images are to be printed, are stacked on the knock-up plate 135.

Referring to FIG. 5, when the pivot shaft 150 is rotated in a counterclockwise direction, the cam 153 is also rotated to be spaced apart from the stop portion 1365. As such, the force to push down the knock-up plate 135 is eliminated, and the knock-up plate 135 is moved upward by the resilient force of the resilient part 140.

Simultaneously, the second boss 1352 slides along the guide hole 1362, such that the stopper 136 is rotated around the pivot shaft 1363 in the clockwise direction. The rotation of the stopper 136 is stopped when the second boss 1352 comes into contact with the other side of the guide hole 1362.

When the stopper 136 is rotated, the support 1364 slides along the groove 111, which prevents the knock-up plate 135 from being shaken.

The paper S stacked on the knock-up plate 135 comes into contact with the idle roller 151, and the pickup roller 152 picks up the paper S by continuously rotating the pivot shaft 150.

After the pickup roller 152 picks up a sheet of paper S, the knock-up plate 135 is maintained in the state shown in FIG. 5, in a ready state to supply more paper S on which images are to be printed.

Figure 6A:
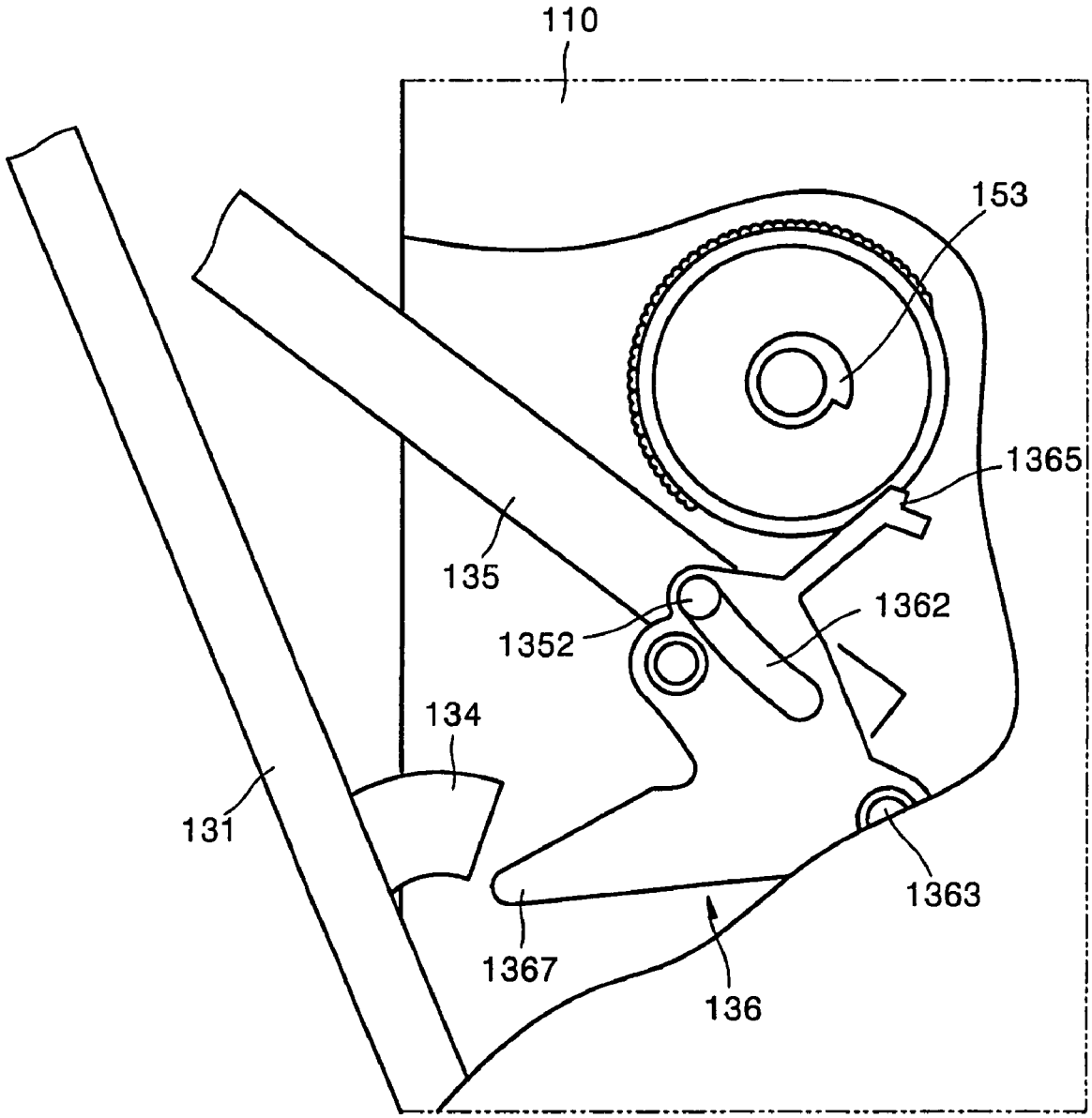
FIGS. 6A and 6B are side views illustrating a process of returning a stopper to its original position when a cover is closed.
Figure 6B:
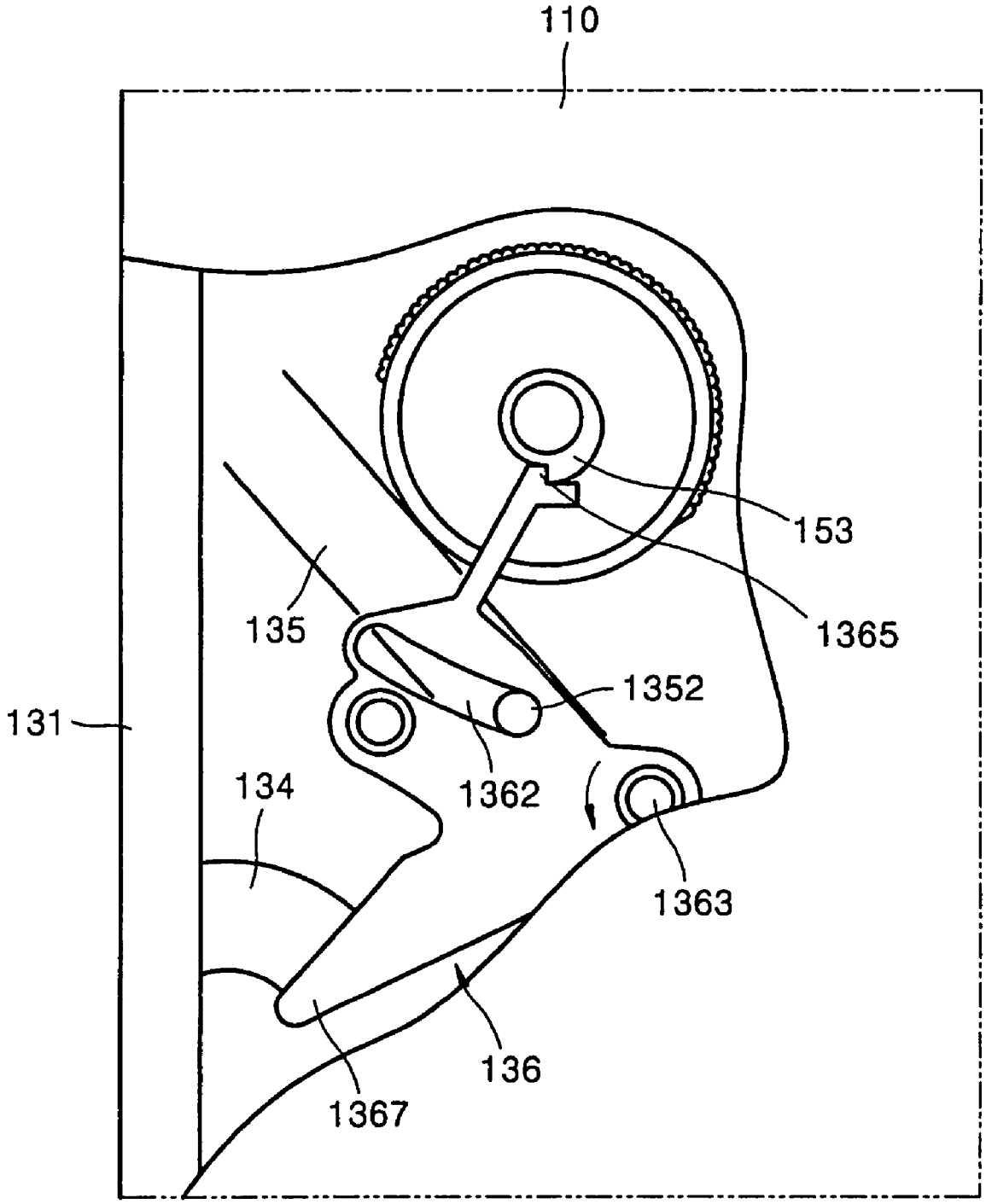

If the printing process is completed, as shown in FIGS. 6A and 6B, the restoring portion 134 comes into contact with the rib 1367 by moving the cover 131 back so as to close with the body 110. The stopper 136 is rotated around the pivot shaft 1363 in the counterclockwise direction, such that the stop portion 1365 is coupled to the cam 153.

The opened state of the cover 131 from the body 110 to implement the described printing operation is shown in FIG. 3.

With the above description, the bypass tray according to the present invention has some advantages in that since the knock-up plate is maintained in a state in which the knock-up plate maintains contact with the idle roller when the paper is fed through the bypass tray, the impact noise is not produced; and since the paper is not shaken, skewing of the paper is prevented so as to eliminate a poor paper feed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A bypass tray comprising:

a cover which is a part of a casing of a body;

a knock-up plate having at least one side slidably supported by the cover, and resiliently biased to an upward direction by a resilient part; and at least one stopper provided at least one side of the knock-up plate, and rotatably provided to the body to restrict a position of the knock-up plate moving up and down, wherein the at least one stopper prevents the knock-up plate from being moved upward when the cover is opened from the body, while the stopper allows the knock-up plate to move upward when a sheet of paper is picked up or is ready to be printed.

2. The bypass tray of claim 1, wherein the knock-up plate comprises at least one boss provided at a side of the knock-up plate; and wherein the at least one stopper comprises:

a base formed with a guide hole through which the boss is slidably inserted, a pivot portion extending from a first side of the base, a stop portion at an end of the pivot portion, and a rib extending from a second side of the base in a direction away from the pivot portion.

3. The bypass tray of claim 2, wherein the base comprises:

a pivot shaft rotatably provided to the body; and a support slidably inserted into a groove provided at the body to stably support the base.

4. The bypass tray of claim 2, further comprising a pickup roller provided at an upper surface of the knock-up plate, the pickup roller rotatably provided around a rotary shaft;

wherein a position of the pivot portion is restricted by a cam provided at the rotary shaft of the pickup roller.

5. The bypass tray of claim 4, wherein the cover comprises a restoring portion;

wherein the restoring portion comes into contact with the rib when the cover is being closed to the body; and the stopper is rotated to a point at which the pivot portion is restricted by the cam.

6. An image forming apparatus including a body provided with a printing portion and a bypass tray pivotally provided to the body to feed a print medium to the image forming apparatus, the bypass tray comprising:

a cover which is a part of a casing of the body;

a knock-up plate having at least one side slidably supported by the cover, and resiliently biased to an upward direction by a resilient part, and provided so that one or more sheets of the print medium may be stacked thereon; and at least one stopper provided at least one side of the knock-up plate, and rotatably provided to the body to restrict a position of the knock-up plate moving up and down, wherein the at least one stopper prevents the knock-up plate from being moved upward when the cover is opened from the body, while the stopper allows the knock-up plate to move upward when a sheet of paper is picked up or is ready to be printed.

7. The image forming apparatus of claim 6, wherein the knock-up plate comprises at least one boss provided at a side of the knock-up plate; and wherein the at least one stopper comprises:

a base formed with a guide hole through which the boss is slidably inserted, a pivot portion extending from a first side of the base, a stop portion at an end of the pivot portion, and a rib extending from a second side of the base in a direction away from the pivot portion.

8. The image forming apparatus of claim 7, wherein the base comprises:

a pivot shaft rotatably provided to the body; and a support slidably inserted into a groove provided at the body to stably support the base.

9. The image forming apparatus of claim 7, further comprising a pickup roller provided at an upper surface of the knock-up plate, the pickup roller rotatably provided around a rotary shaft;

wherein a position of the pivot portion is restricted by a cam provided at the rotary shaft of the pickup roller.

10. The image forming apparatus of claim 9, wherein the cover comprises a restoring portion;

wherein the restoring portion comes into contact with the rib when the cover is being closed to the body; and the stopper is rotated to a point at which the pivot portion is restricted by the cam.

11. A bypass tray to be used in an image forming apparatus, the bypass tray comprising:

a knock-up plate resiliently biased in an upward direction; and at least one stopper provided at least one side of the knock-up plate, rotatably provided so as to restrict a position of the knock-up plate while moving up and down, wherein the at least one stopper prevents the bypass tray from moving upward until a printing operation is to be performed.

12. The bypass tray of claim 11, wherein the at least one stopper is coupled to a body of the image forming apparatus and the knock-up plate so as to provide support for the knock-up plate while moving up and down.

13. The bypass tray of claim 12, wherein the knock-up plate comprises at least one boss provided at a side of the knock-up plate; and wherein the at least one stopper comprises a guide hole through which the boss reciprocally slides as the knock-up plate moves up and down.

14. The bypass tray of claim 13, wherein the at least one stopper further comprises a support boss which reciprocally slides through a support groove of the body of the image forming apparatus as the knock-up plate moves up and down.

15. The bypass tray of claim 11, wherein the bypass tray is integrated with a cover that is coupled to a body of the image forming apparatus, and a closing of the cover causes the at least one stopper to be engaged so as to prevent the movement of the bypass tray.

16. The bypass tray of claim 11, wherein a rotation of a pickup roller causes the at least one stopper to become disengaged so as to allow the movement of the bypass tray.

* * * * *

UNITED STATES PATENT AND TRADEMARK OFFICE

CERTIFICATE OF CORRECTION

PATENT NO. : 7,510,180 B2
APPLICATION NO. : 11/246222
DATED : March 31, 2009
INVENTOR(S) : Kyung-hwan Jang et al.

It is certified that error appears in the above-identified patent and that said Letters Patent is hereby corrected as shown below:

Title Page item [57], Column 2 (Abstract), Line 3, after “provided” insert --at--.

Column 5, Line 1, after “provided” insert --at--.

Column 5, Line 43, after “provided” insert --at--.

Column 6, Line 26, after “provided” insert --at--.

Signed and Sealed this

Sixteenth Day of June, 2009

John Doll

JOHN DOLL
*Acting Director of the United States Patent and Trademark Office*